US007568250B2

(12) United States Patent
Menard-Flanagan

(10) Patent No.: US 7,568,250 B2
(45) Date of Patent: Aug. 4, 2009

(54) BOTTLE OPENER CLIP

(76) Inventor: Daniel R. Menard-Flanagan, P.O. Box 30102, Columbia, MO (US) 65205

( * ) Notice: Subject to any disclaimer, the term of this patent is extended or adjusted under 35 U.S.C. 154(b) by 18 days.

(21) Appl. No.: 12/070,436

(22) Filed: Feb. 19, 2008

(65) Prior Publication Data

US 2008/0201862 A1 Aug. 28, 2008

Related U.S. Application Data

(60) Provisional application No. 60/903,723, filed on Feb. 27, 2007.

(51) Int. Cl.
*B67B 7/00* (2006.01)
*B67B 7/44* (2006.01)

(52) U.S. Cl. ..... 7/151; 81/3.09; 81/3.36; 81/3.55; 24/3.7; 24/3.12

(58) Field of Classification Search ..... 7/151; 81/3.09, 3.36, 3.55; 24/3.7, 3.12
See application file for complete search history.

(56) References Cited

U.S. PATENT DOCUMENTS 2,473,870 A * 6/1949 Eastman ..... 81/3.36
4,361,920 A 12/1982 Zanni
4,363,432 A * 12/1982 Warthen ..... 224/247
4,373,223 A 2/1983 Miller
4,486,169 A 12/1984 Lewis
4,560,344 A 12/1985 Kietaibl
4,569,653 A 2/1986 Becker et al.
4,625,861 A 12/1986 Krog
4,642,827 A 2/1987 Kanruzas
4,854,856 A 8/1989 Steiger, Jr. et al.
4,923,392 A 5/1990 Moynihan
5,169,305 A 12/1992 Kee
5,271,730 A 12/1993 Acacio da Silva
D350,216 S * 8/1994 Heaton ..... D27/144
5,829,965 A 11/1998 Rubalcava
D409,464 S 5/1999 Garza
6,142,769 A 11/2000 Walker
6,212,721 B1 * 4/2001 Borodulin et al. ..... 7/156
D444,685 S 7/2001 Shenkel et al.
D461,427 S * 8/2002 Braner ..... D11/78.1
D465,709 S 11/2002 Robinson
6,544,030 B1 4/2003 Evers
6,851,147 B2 2/2005 Abrahall
D557,089 S 12/2007 Menard

* cited by examiner

*Primary Examiner*—Joseph J Hail, III
*Assistant Examiner*—Shantese McDonald
(74) *Attorney, Agent, or Firm*—Paul M. Denk

(57) ABSTRACT

A single piece clip has two arms that together hold a lighter, and one arm serves as a bottle opener. The inside arm is parallel and spaced apart from the outside arm and both arms join at a common shoulder. The inside arm widens down from the shoulder into a loop bottle opener while the outside arm extends away from the shoulder into a pointed tongue with a loop for a key ring. The outside arm has a pair of flanking flanges spaced apart to receive a disposable lighter. The shoulder and spaced apart arms allows the clip to fit upon a belt with the outside arm outward and the inside arm between the belt and the trousers. The clip has a compact form that fits comfortably upon a person.

7 Claims, 2 Drawing Sheets

BOTTLE OPENER CLIP

CROSS REFERENCE TO RELATED APPLICATION

This provisional patent application claims priority to the non-provisional application Ser. No. 60/903,723, filed on Feb. 27, 2007, which claims priority to the non-provisional application for patent Ser. No. 29/267,695 which was filed on Oct. 19, 2006 and is commonly owned by the same inventor.

BACKGROUND OF THE INVENTION

This invention relates generally to manual bottle opening devices and more specifically to a bottle opener that also holds a lighter and clips to a belt.

For many years, beverage consumers, bartenders, grocers, and others involved with bottled beverages have used openers to remove the caps from bottles. Beverages and other liquids can be served from a tap but that requires a fixed facility such as a bar. Consumers though often seek portable beverages such as those now in cans and bottles. Cans have integral openers in the top. However, bottles usually have a cap.

Generally bottles are made of one material and the cap of another. Bottles have a material that is usually translucent and often transparent. The material resists degradation by the acids in a beverage and allows inspection of the beverage by the bottler and the consumer. Soda, or pop, bottles are generally plastic, polyethylene terephthalate, PET, with a plastic screw on cap. The screw on cap resists the pressure from the carbonated beverage therein and can be replaced on the bottle.

Bottles for alcoholic beverages are generally glass, brown for beer, green for wine, and clear for spirits. The glass resists the alcohol created during fermentation and aging of the beverage in storage. The glass also is inert and does not influence the flavoring of the beverage. As glass is brittle, glass does not work well as a cap. The bottling industry uses metal caps to close and to secure the tops of bottles. Generally a bottle has a neck with a round top with a rounded edge. A metal cap, starting as a disc, is placed upon the top of the neck and then crimped around the edge. Though some caps may twist off a bottle, metal caps sometimes jam upon the top.

Those people who drink and serve bottled beverages require a means to remove caps. Though some bold persons remove caps with their teeth, others use suitable tools. A common tool is a two point lever. The lever has one point placed upon the center of the cap and the other point placed below the lip of the cap. Lifting the lever raises the lip as the lever turns upon the fulcrum of the first point. In lifting the lip, the cap is deformed and expanded so it can be removed from a bottle top. These levers are pocket size, made of plastic with one metal point, and emblazoned with logos or advertising.

Another common tool is a wrench, often called a "church key." The wrench has a handle with a head upon one end. The head is open and has a straight edge opposite the handle. Inside of the straight edge, the head has a tooth at the end of the handle. In use, the tooth is placed beneath the lip of the cap and the straight edge is placed across the cap. Lifting the handle away from the bottle raises the lip, deforms the cap, and allows access to the contents of the bottle.

Both of these tools now exist in many varieties. Some hold keys or fobs, and other also work as lights. However, few hold lighters and fit upon a belt.

DESCRIPTION OF THE PRIOR ART

Others have sought to combine other features with a loop or wrench type bottle opener. The U.S. patent to Moynihan, No. 4,923,392 shows a beverage opener and bottle holder. This holder has a belt clip upon a chamber that receives a lighter lengthwise therein. Below the chamber, this holder has a loop type opener. Unlike the present invention, this holder has a greater length and requires insertion of a lighter axially into a chamber.

The U.S. patent to Garza, Des. 4,094,464 shows the design for a combined money clip and bottle opener. The bottle opener extends away from the money clip but does not hold a lighter.

The U.S. patent to Zanni, No. 4,361,920 describes an elongated lighter and bottle opener. The opener has a torpedo like shape with an opener at one end and a switch for the lighter extending outwardly from the middle. This opener lacks a belt clip feature.

The U.S. patent to Miller, No. 4,373,223 shows a lighter with a lighting mechanism at one end and a bottle opener at the other end. This invention deals with the body itself for a lighter without combination to a belt clip or separate bottle opening loop.

The U.S. patent to Lewis, U.S. Pat. No. 4,486,169 illustrates a lighter holder. This holder includes a retractable cord and a belt clip. However, this holder does not have a bottle opening feature.

Similar to Miller, the U.S. patent to Kietaibl, No. 4,560,344 has a lighter body with a bottle opener upon the bottom end. This lighter body has a width to provide leverage to the opener tooth. However, it lacks a belt clip feature.

The U.S. patent to Becker et al., No. 4,569,653 describes a lighter with a cap opener opposite the lighting mechanism. The cap opener is a hook extending away from the lighter body that grips the lip of a cap. The lighter body is then pressed towards the bottle to open the cap. This invention lacks a belt clip and risks breakage of a lighter body.

The U.S. patent to Krog of Denmark, No. 4,625,861 shows a lighter case with a bottle opener on one end similar to Miller and Kietaibl. The case receives a lighter lengthwise and the bottom of the case has a hook that grips the lip of a cap and the case is then pushed towards the center of the cap.

As in Krog, the U.S. patent to Karuzas of Canada, No. 4,642,827 shows another lighter cover. This cover has a notch upon the bottom that grips the crown cap, or lip, and a sleeve that receives part of the length of a lighter. The lighter is then used as a lever to remove the cap. This cover does not have a belt clip or loop opener as in the present invention.

The U.S. patent to Steiger et al., No. 4,854,856, illustrates a lighter with an elongated body. The body has a typical lighter mechanism and fuel tank at one end and a loop opener extending oppositely. The lighter portion can be replaced but the body does not have a belt clip or short length as in the present invention.

The U.S. patent to Key, No. 5,169,305 has a lighter with a body having three features at the opposite end. Two features involve bottle opening and the third is a key ring. The bottle opening features are to the side of the lighter but this lighter does not have a loop bottle opener or a belt clip.

The U.S. patent to Acacio da Silva of Brazil, No. 5,271,730 describes a key ring that is mechanically connected to the bottom of a metallic lighter. The key ring also has a latch for releasably gripping a belt loop. As this invention lacks a bottle opener, it differs from the present invention.

The U.S. patent to Rubalcava, No. 5,829,965 discloses a lighter with an extended fuel tank. The fuel tank extends into a handle for a waiter's tool opposite the lighting mechanism. This invention lacks the belt clip and clip for detaching of a lighter in the present invention.

The U.S. patent to Walker, No. 6,142,769 shows a multi-purpose tool with a lighter as one tool. The other tools include a bottle opener, pen size light, saw blade and corkscrew. The tools fold upon the main body and make the tool compact with a minimum volume of space. As this tool has an integral lighter, it differs substantially from the present invention that receives a separate lighter.

The U.S. patent to Evers, No. 6,544,030 has a combined lighter and bottle opener. Similar to the Miller and other patents, this patent has a lighter with a fuel tank that has a bottle opener opposite the lighting mechanism. This bottle opener is a semi-circle inwardly to the fuel tank. The diameter and knurling of the bottle opener allow the user to twist off or turn bottle caps. This is not the present invention of a loop bottle opener.

The U.S. patent to Abrahall, No. 6,851,147 shows a money clip with a bottle opener feature. The money clip is bent metal in a tight elongated C shape. At the bend of the C, the clip has a notch suitable as a lever type bottle opener. As this clip lacks a feature involving a lighter, this patent differs from the present invention.

The U.S. patent to Shenkel et al., No. Des. 444,685 shows a karabiner type key chain with a loop bottle opener. This invention does not show a lighter or clip and thus differs from the present invention.

And, the U.S. patent to Robinson, No. Des 465,709 shows a lighter holder. This holder appears as a hollow cylinder capped at one end with a key ring. A lighter fits within the holder with the lighting mechanism opposite the key ring. This design does not show a clip shape and thus it differs from the present invention.

The prior art has sought to combine lighters and bottle openers but has not combined belt clips with lighters and bottle openers. Further, the compact and folded shape of the present invention sets it apart from the prior art.

SUMMARY OF THE INVENTION

The present invention provides a single piece clip having two arms. The inside arm is parallel and spaced apart from the outside arm and both arms join at a common shoulder. The inside arm widens down from the shoulder into a loop bottle opener while the outside arm extends away from the shoulder into a pointed tongue with a loop for a key ring. The outside arm has a pair of flanking flanges spaced apart to receive a lighter, generally of the disposable type. The shoulder and spaced apart arms allow the clip to fit upon a belt with the outside arm outward and the inside arm between a belt and trousers.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is, therefore, the principle object of this invention is to provide a clip that releasably holds a lighter and serves as a bottle opener.

Another object of this invention is to provide a clip that fits upon a belt.

Another object of this invention is to provide a clip that has a compact form and rounded edges for a comfortable fit upon a person's waist.

Another object of this invention is to provide a clip that secures a ring for keys, a line, or a retractable cable.

Another object of this invention is to provide a clip that is formed from a single piece of material.

Another object of this invention is to provide a clip of a material that resists the forces upon it during lifting of a bottle cap.

These and other objects may become more apparent to those skilled in the art upon review of the summary of the invention as provided herein, and upon undertaking a study of the description of its preferred embodiment, in view of the drawings.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
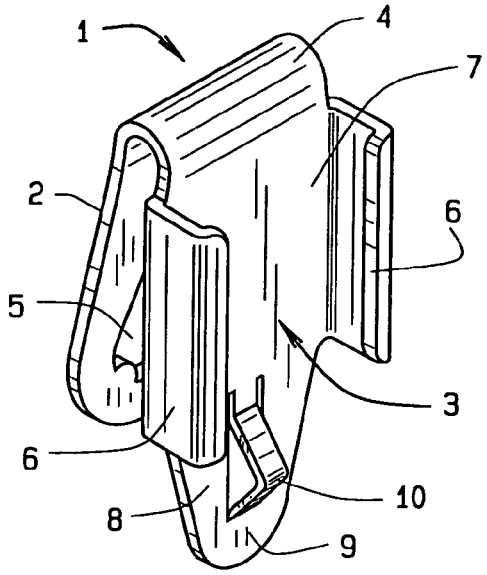
FIG. 1 shows an isometric view of the clip of the present invention.

The present invention takes shape in FIG. 1 as a bottle opener that holds a lighter, as a clip 1 for placement upon a person's belt. The clip has two arms, mutually parallel and spaced apart, that are joined at a shoulder 4. The inside arm 2 has a bottle opener 5 and is generally located between a belt and a person's trousers. Opposite the inside arm, the outside arm 3 receives a lighter (not shown) and is generally located outside of a belt for ready retrieval of a lighter. The outside arm descends from the shoulder 4 and has a length greater than that of the inside arm. The outside arm has two parallel and spaced apart flanges 6 that extend generally perpendicular to the outside arm and opposite the inside arm. The flanges 6 are spaced apart to allow for a snug fit of a lighter into a slot 7 formed between the flanges. Each flange extends downwardly away from the shoulder for a portion of the length of the outside arm. Below the flanges, the outside arm 3 extends into a tongue 8. The tongue descends below the inside arm and tapers from the width of the slot to a narrower tip 9 opposite the shoulder. The tip is generally rounded. Within the tongue, the outside arm has a loop 10 that extends perpendicular to the outside arm and opposite the inside arm. The loop connects to the tongue upon at least one point, here shown as two where the loop is a piece of material slit and bent from the tongue. In the preferred embodiment, the loop has a generally triangular form that remains open to receive keys, a chain, a line, or another ring.

Figure 2:
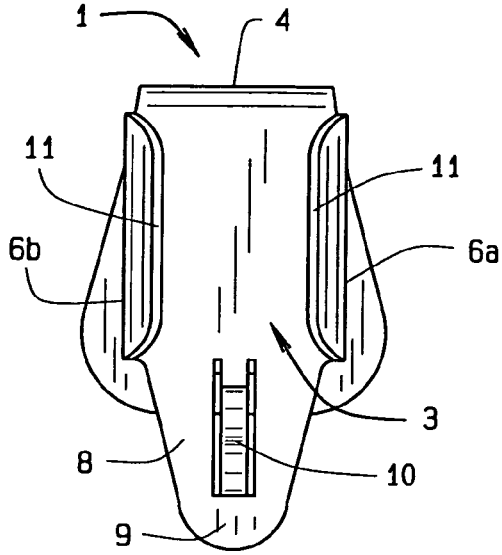
FIG. 2 shows an outward view of the clip, particularly the outside arm.

The outside arm 3 is shown in FIG. 2 as an outside view of the clip 1 with the inside arm 2 in the background. The outside arm receives a lighter between the flanges 6. Each flange extends perpendicular to the outside arm and ends in a lip 11 that bends inwardly to wrap partially around the fuel tank of a lighter. The flanges are shown symmetric about the centerline of the outside arm and extend downwardly from the shoulder 4 to where the tongue 8 begins. In an alternate embodiment, the flanges have different lengths to ease retrieval of a lighter toward the front of a person wearing the clip 1 upon a belt. A clip worn on the right has the right flange 6*a* of shorter length and when worn on the left has the left flange 6*b* of shorter length. In the preferred embodiment, below the flanges the tongue 8 narrows in width from the slot 7 to the rounded tip 9. The rounded tip is approximately 55% of the width of the slot. The loop 10 is generally upon the centerline of the outside arm and centered between the end of the flanges and the tip. In the preferred embodiment, the loop forms from slitting the tongue with two parallel longitudinal slits and the material within the slits is then pulled and stretched outwardly of the outside arm. In the background of this figure, the inside arm attains a greater width than the inside arm.

Figure 3:
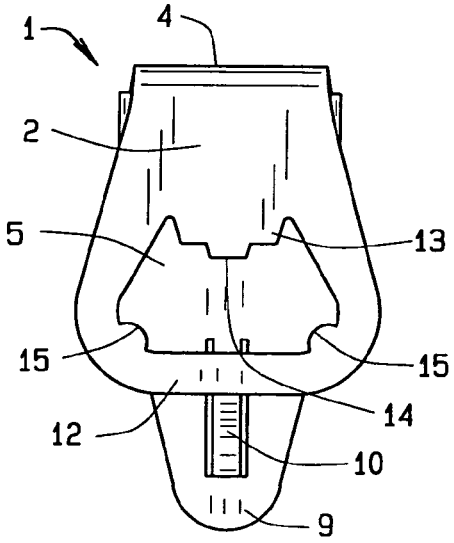
FIG. 3 describes an inward view of the clip, particularly the inside arm.

An inside view of the clip 1 is shown in FIG. 3, generally opposite that of FIG. 2. Descending from the shoulder 4, the inside arm 2 begins with the width of the shoulder and then widens to a loop type bottle opener 5 enclosed by a rim 12 furthest from the shoulder. The loop opener has a somewhat trapezoidal shape with the bases of the shape parallel to the shoulder. Upon the shorter base, or narrow part of the loop, the opener 5 has a tooth 13 that extends into the loop, or opening of the opener. The tooth 13 is coplanar with the outside arm and extends substantially along the width of the shorter base. The tooth has its tip 14 centered and partially along the width of the tooth and extending further into the opening of the opener. Opposite the tooth 13, the loop opener 5 has a longer base, or wide part of the loop. At each end of the longer base, the opener 5 has a rounded ear 15 that juts into the opening of the opener. Though a rounded ear is described, other shapes are possible. The tip of the tooth and the ears cooperate to grip and then to deform a crown type bottle cap and open a bottle. The ears grip the top of a cap and serve as a fulcrum while the tip grips the lip of a bottle cap and lifts it upwardly. In the background, the tongue extends below the inside arm as previously described.

Figure 4:
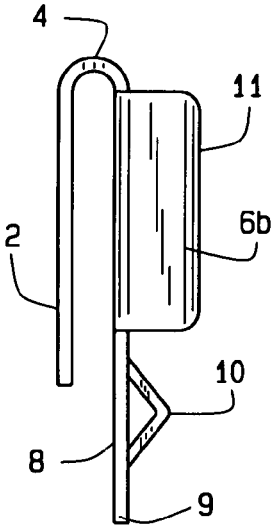
FIG. 4 shows a left side view of the clip.
Figure 5:
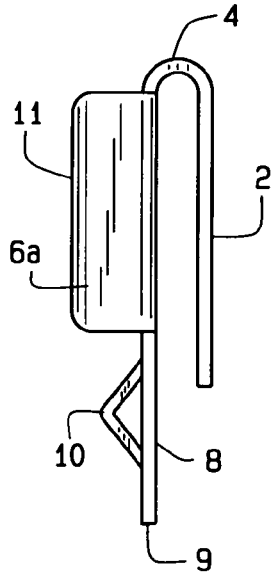
FIG. 5 shows a right side view of the clip.

FIG. 4 shows a side view of the clip with the left flange 6*b* visible. The flange 6*b* extends perpendicular to the outside arm and opposite the inside arm. The inside arm 2 is shown spaced apart from the outside arm 3 by the bend of the shoulder 4. The shoulder has a semi-circular bend that provides a space between the inside arm and the outside arm for placement of the clip upon a belt. The flange is shown extending the full length of the slot from the shoulder to the base of the tongue. Below the flange 6*b*, the loop 10 extends outwardly from the tongue 8 generally in the same direction as the flange 6*b*. The loop forms an aperture between it and the tongue that will hold a split ring, as for keys, a karabiner, a chain, or a line from a retractable key ring among other things. In its present form, the clip 1 is symmetric about its longitudinal centerline. Thus FIG. 5 is a reverse side view of FIG. 4 that shows the right flange 6*a* with the inside arm 2 spaced away from the outside arm as before.

Figure 6:
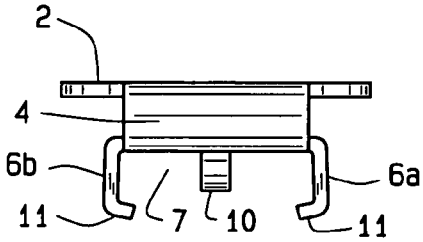
FIG. 6 illustrates a top view of the shoulder of the clip.

Viewing the clip 1 from the top, FIG. 6 shows the shoulder 4 in the foreground with the inside arm 2 in the upper part of the figure. The inside arm is shown widening away from the shoulder. Away from the inside arm, the outside arm extends from the opposite side of the shoulder here in the lower part of the figure. The outside arm is hidden in this view but the left flange 6*a* and the right flange 6*b* extend opposite the insider arm and form the slot 7 between them. The slot receives a lighter as later shown in FIG. 8. Below the slot, the tongue has the loop 10 extending outwardly in the same direction as the flanges. In this embodiment, the loop has less depth than the depth of the flanges which holds keys and other objects closer to the tongue for safekeeping.

Figure 7:
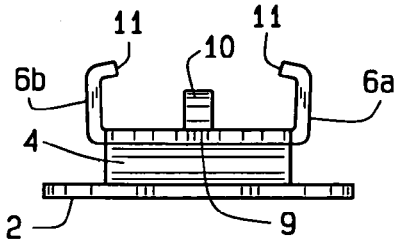
FIG. 7 illustrate a bottom view of the tongue with the shoulder in the background of the clip; and, FIG. 8 describes a lighter placed into the clip and received within the flanges.

Rotating the clip, FIG. 7 shows the bottom view of the invention generally from the tip of the tongue upwards. The tip 9 is the lowest point of the tongue 8 of the outside arm 3. The tongue widens upward from the tip to space apart the flanges 6*a*, 6*b* to receive a lighter into the slot 7. Below the outside arm 3, the shoulder 4 bends in a semi-circular fashion to space apart the inside arm 2. The inside arm 2 is generally wider than the outside arm 3 so that the opener admits a crown type bottle cap.

Figure 8:
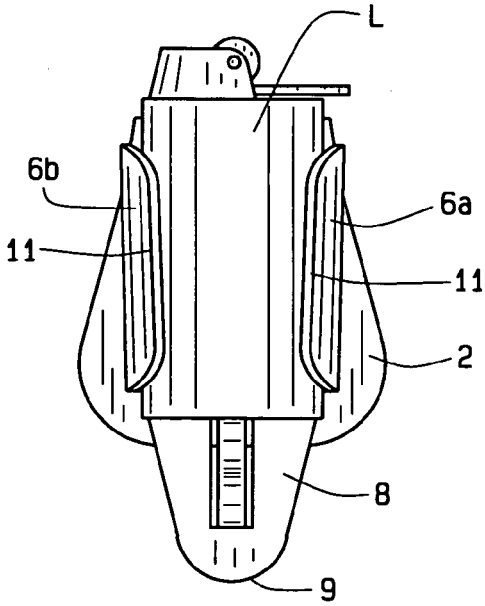

As the invention has been described, FIG. 8 shows the invention with a lighter L placed in the slot between the flanges 6*a*, 6*b*. The lips 11 of the flanges grasp around the fuel tank of a disposable lighter, such as those made by Bic®. The lighter is received into the slot and comes to rest upon the upper end of the loop 11 with the lighting mechanism of the lighter extending above the shoulder.

Alternatively, the flanges 6*a*, 6*b* are spaced apart but at a skew that narrows towards the tongue. Both flanges are skewed upon a common centerline and thus taper the shape of the slot. The slot is wider near the shoulder to accept and then to guide a lighter when inserted by a wearer of the clip. The slot then narrows slightly above the loop to grip the fuel tank of a lighter. The alternate embodiment of the flanges holds the lighter within the clip in a pinch fit at the narrow end of the slot.

The lighter can be placed with the lighting mechanism to the left or the right of the present invention. Each wearer of the clip will locate the clip upon a belt and the lighting mechanism where it feels most comfortable. The wearer can then emplace and retrieve a lighter readily from the clip.

Variations or modifications to the subject matter of this development may occur to those skilled in the art upon review of the invention as described herein. Such variations, if within the spirit of this development, are intended to be encompassed within the scope of the invention as explained. The description of the preferred embodiment and as shown in the drawings, are set forth for illustrative purposes only to show the principle of this bottle opener clip.

I claim:

1. A device for removing bottle caps while holding a lighter, said device capable of resting upon a belt of a person, comprising:

an inside arm, including a bottle opener;

a shoulder joining to said inside arm opposite said opener;

an outside arm extending from said shoulder, parallel to and spaced apart from said inside arm, having two spaced-apart flanges, said flanges forming a slot therebetween for receiving a lighter axially;

said inside arm said shoulder, and said outside arm forming a clip suitable for placement upon the edge of a belt;

said outside arm having a tongue extending below said flanges, said tongue narrowing towards a tip;

said tip being rounded; and a loop extending perpendicular to said tongue, generally centered upon said tongue.

2. The bottle cap remover with lighter holder device of claim 1, further comprising:

said bottle opener having a loop form widening said inside arm away from said shoulder.

3. The bottle cap remover with lighter holder device of claim 1, further comprising:

said flanges each having a lip extending inwardly and opposite said outside arm.

4. The bottle cap remover with lighter holder device of claim 1, wherein said flanges have the same length and said clip is symmetric about the longitudinal axis.

5. The bottle cap remover with lighter holder device of claim 1, further comprising:

said flanges including a right flange and a left flange, said right flange having a different length than said left flange, whereby the flange of shorter length directs removal of said lighter from said blot.

6. The bottle cap remover with lighter holder device of claim 1, wherein said loop is triangular in shape.

7. The bottle cap remover with lighter holder device of claim 1, further comprising:

said flanges being spaced apart and upon a common skew; and, said slot having a tapering shape wider near said shoulder and narrower away from said shoulder.

* * * * *